US009656782B2

(12) United States Patent
Park

(10) Patent No.: US 9,656,782 B2
(45) Date of Patent: May 23, 2017

(54) STRUCTURE FOR DETACHABLE COUPLING OF CONTAINERS

(71) Applicant: Jong Soo Park, Daegu (KR)

(72) Inventor: Jong Soo Park, Daegu (KR)

( * ) Notice: Subject to any disclaimer, the term of this patent is extended or adjusted under 35 U.S.C. 154(b) by 110 days.

(21) Appl. No.: 14/076,632

(22) Filed: Nov. 11, 2013

(65) Prior Publication Data

US 2014/0061150 A1 Mar. 6, 2014

Related U.S. Application Data

(63) Continuation-in-part of application No. 12/726,878, filed on Mar. 18, 2010, now Pat. No. 8,613,358.

(51) Int. Cl.

| | |
|---|---|
| ***B65D 21/02*** | (2006.01) |
| ***A47G 19/23*** | (2006.01) |
| ***B65D 17/00*** | (2006.01) |

(52) U.S. Cl.

CPC ..... *B65D 21/0204* (2013.01); *A47G 19/23* (2013.01); *B65D 17/165* (2013.01); *B65D 21/0213* (2013.01); *B65D 21/0231* (2013.01); *B65D 2517/0056* (2013.01); *B65D 2517/0062* (2013.01)

(58) Field of Classification Search

CPC combination set(s) only.
See application file for complete search history.

(56) References Cited

U.S. PATENT DOCUMENTS

| | | | |
|---|---|---|---|
| 826,796 | A | 7/1906 | McManus |
| 1,341,592 | A | 5/1920 | Ruehle |
| 1,586,273 | A | 5/1926 | Wall |
| 2,148,169 | A | 2/1939 | Merolle |
| 2,182,017 | A | 12/1939 | Donaghy |

(Continued)

FOREIGN PATENT DOCUMENTS

| | | | |
|---|---|---|---|
| EP | 0436107 | A2 | 7/1991 |
| FR | 2684072 | A1 | 5/1993 |

(Continued)

OTHER PUBLICATIONS

U.S. Appl. No. 14/076,680, filed Nov. 11, 2013, Park.

*Primary Examiner* — Fenn Mathew
*Assistant Examiner* — Madison L Poos
(74) *Attorney, Agent, or Firm* — Oblon, McClelland, Maier & Neustadt, L.L.P.

(57) ABSTRACT

A container structure is provided for detachable coupling of containers. The detachable coupling structure of a first container includes a top portion with an upstanding perimeter having radial protrusions extending from a surface of the upstanding perimeter, and a container bottom portion having a complementary structure to engage the radial protrusions of the top portion of a second container for the purpose of detachably coupling two or more containers end to end. In one embodiment, two containers placed end to end with their respective structures aligned to be engaged are rotated in opposite directions to fully engage the protrusions of one container with the complementary structure of the other. A rim around the top portion of a container in a second embodiment has a larger diameter than the top portion. The rim may be pushed through a flexible opening into a recess in the bottom of another container.

28 Claims, 15 Drawing Sheets

(56) References Cited

U.S. PATENT DOCUMENTS

| | | | | |
|---|---|---|---|---|
| 2,257,715 | A | 9/1941 | Hopkins | |
| 2,997,199 | A | 8/1961 | Reachi | |
| 3,029,973 | A | 4/1962 | Burchett | |
| 3,369,691 | A | 2/1968 | Wei | |
| 4,624,383 | A | 11/1986 | Moore | |
| 4,689,147 | A | 8/1987 | Leoncavallo et al. | |
| 4,691,828 | A | 9/1987 | Slusarczyk et al. | |
| 5,007,551 | A | 4/1991 | Baroi | |
| 5,064,082 | A | 11/1991 | Lombardi et al. | |
| 5,154,295 | A | 10/1992 | Stoner | |
| 5,244,106 | A | 9/1993 | Takacs | |
| 5,320,233 | A | 6/1994 | Welch | |
| 5,339,975 | A | 8/1994 | Stoner | |
| 5,573,133 | A | 11/1996 | Park | |
| 5,743,423 | A | 4/1998 | Franco | |
| 5,967,352 | A * | 10/1999 | Repp et al. | 215/256 |
| 6,276,549 | B1 | 8/2001 | Fasci et al. | |
| 6,318,573 | B1 | 11/2001 | Montero | |
| 7,377,383 | B2 * | 5/2008 | Henry | B65D 81/3211 206/222 |
| 7,644,828 | B1 | 1/2010 | Klein | |
| 2004/0020890 | A1 | 2/2004 | Tan et al. | |
| 2006/0249471 | A1 | 11/2006 | Leposavic et al. | |
| 2007/0012693 | A1 | 1/2007 | Kummer | |
| 2009/0045157 | A1 * | 2/2009 | Panchal et al. | 215/10 |
| 2009/0090647 | A1 | 4/2009 | Panchal et al. | |
| 2009/0127152 | A1 * | 5/2009 | Bou-Mezrag | 206/507 |
| 2009/0255893 | A1 | 10/2009 | Zummo et al. | |
| 2009/0266782 | A1 * | 10/2009 | Lane | 215/10 |

FOREIGN PATENT DOCUMENTS

| | | |
|---|---|---|
| JP | 54-58350 | 4/1979 |
| JP | 63-1727 | 1/1988 |

* cited by examiner

*Fig. 13A*
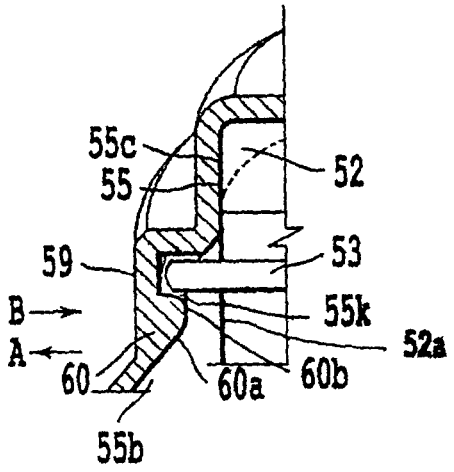
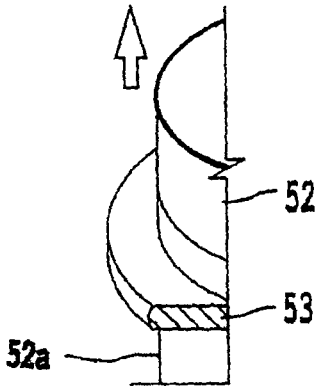
*Fig. 13B*

STRUCTURE FOR DETACHABLE COUPLING OF CONTAINERS

BACKGROUND OF THE INVENTION

This application is a continuation-in-part of and claims the benefit under 35 U.S.C. §120 from U.S. Ser. No. 12/726,878, filed Mar. 18, 2010, the entire contents of which is incorporated herein by reference.

FIELD OF THE INVENTION

The present invention relates in general to containers such as beverage cans and bottles and, more particularly, to structures in such cans and bottles for simply achieving detachable coupling of two or more containers.

DESCRIPTION OF THE RELATED ART

Most typical containers have been produced and commercialized in handheld sizes that have no means for detachable coupling to each other. Therefore, most of the typical containers having no detachable coupling means are separately kept or carried with a person when one or two containers need to be kept or carried. This creates a problem that it is very difficult for a person to keep or carry three or more containers simultaneously.

As is well known to those skilled in the art, cans are conventionally formed of iron thin plates or aluminum thin plates, and bottles are conventionally formed of glass, plastics, or metals. Materials for forming containers should be saved from the viewpoint of conservation of resources. In order to conserve resources, the emptied containers need to be recovered and reproduced. However, since there is difficulty in holding more than one container in each hand, there is a problem that they must be collected one by one when gathering them for their recycling. Since most of the typical containers have no means for coupling them to each other, there is no simple means for simultaneously gathering multiple containers. Thus, the emptied containers are usually discarded separately. Since the typical containers having no detachable coupling means, they are usually discarded separately in the open air, or scattered in the forest or in the sands. Hence, when the emptied containers separately discarded are collected for recycling, they must be picked up one by one when found, and this creates problems for container collectors. Hence, the containers separately discarded in the open air may be neglected. This not only runs counter to the need for resource saving but also causes environmental pollution.

In the prior art, there have been proposed detachable can coupling structures and detachable can coupling methods for overcoming the above problems caused by the typical cans having no coupling means. However, the prior art structures and methods for coupling the cans are not practically used because of their structural problems as will be described later herein.

Japanese Utility Model Laid-open Publication No. Sho. 54-58350 discloses a can having, at its top and bottom, a screw type coupling structures for vertically detachably coupling the cans to each other. However, this can causes a hygienic problem in that the contaminants on its top coupling structure may be introduced into the human body when drinking the beverage from the can. That is, the screw type top coupling structure has recesses between its threads, and contaminants may be present in those recesses. In this regard, the contaminants remaining on the top coupling structure may be directly introduced into the human body along with the beverage when drinking the canned beverage, thus causing a hygienic problem. In addition, each of the top and bottom coupling structures of the above can is shaped in the form of a predetermined width of annular strip extending from the top periphery or the bottom periphery of the can. The top and bottom screw type coupling structures of the can are thus weak in their bending strengths so that they are apt to be deformed or bent even when they are subjected to a weak outside shock. When either of the top and bottom coupling structures of the can is deformed by an outside shock, this can cannot be coupled to another can at its top or bottom. In this regard, the above can is attended with a problem in its practical use.

Japanese Utility Model Laid-open Publication No. Sho. 63-1727 discloses a pair of cans having another type of can coupling structure for detachably coupling the two cans to each other. In this device, the can coupling structure comprises a slot flange extending upwardly from the top periphery of the bottom can to a predetermined length and slitted at predetermined positions so as to form diametrically opposed locking slide slots in an L-shape. In order to engage with the above L-shaped locking slide slots of the bottom can for achieving the detachable coupling of the cans, the top can is provided with a pair of locking slide projections extending outwardly from its bottom side at positions corresponding to the above locking slide slots. In accordance with this device, the two cans or the top and bottom cans are coupled to each other by bringing the projections of the top can into engagement with the L-shaped slots of the bottom can. However, when the top periphery of the bottom can is partially slitted so as to form the L-shaped locking slide slots, the can may not achieve the desired hermetical sealing due to the structural limit of the typical can. Moreover, even when the L-shaped locking slots are formed on the top periphery of the can while providing the can with the desired hermetical sealing, another problem is caused by the material of the can. That is, since the can is made of the iron thin plate or the aluminum thin plate as described above, the slot flange of the bottom can having the L-shaped slots is apt to be deformed or bent by an outside shock, thus failing in its engagement with the projections of the top can. Particularly when the can is made of the aluminum thin plate, which plate is softer and shows less elasticity than the iron thin plate, the above problem of bending deformation of the slot flange will become worse. Accordingly, this coupling structure can not be adapted to typical cans.

U.S. Pat. No. 5,573,133 discloses a can structure for detachable coupling of at least two cans. The detachable coupling structure includes a plurality of L-shaped grooves on an outside surface of a bottom peripheral ring of each can such that each of them has a receiving portion and a locking portion. The detachable coupling structures also includes a plurality of projections extending inwardly from an inside surface of a top peripheral flange of each can at positions corresponding to the grooves. In order to attach the cans together using this detachable coupling structure, the projections need to be aligned with an end of the L-shaped grooves, inserted into the grooves until the projection reaches the turn in the L-shaped groove and then moved down the length of the L-shaped groove to the locking position.

People of all ages transport and consume beverages in beverage containers in many parts of the world irrespective of the above problems caused by the prior art containers. The frequent and widespread use of the prior art beverage containers presents a significant need for proposing a new beverage container. Such a new container should have a new structure for overcoming the above problems of the prior art containers and should provide for detachably coupling the containers to each other when keeping and carrying them with the person. The worldwide need to conserve resources promotes such a proposal of the new containers having the new detachable coupling structure suitable for making the emptied containers easily and simply recovered for their recycling.

OBJECTS OF THE INVENTION

It is, therefore, an object of the present invention to provide a container with a structure for detachable coupling which easily achieves the desired manual detachable coupling of containers to each other without addition of another means, thus facilitating the keeping or carrying of two or more cans in the user's hands, the coupling structure also allows repeated detachable coupling of the containers without causing any container structure problems.

It is another object of the present invention to provide a container with a structure for detachable coupling of containers, in which the structure easily, manually, detachably couples the containers to each other when discarding and keeping the containers after emptying the containers of their contents, thus allowing the emptied containers to be discarded or kept while being coupled to each other, and thus allowing the emptied containers to be more efficiently recovered for their recycling and improving the recovery rate of the emptied containers.

It is still another object of the present invention to provide a container structure for detachable coupling of containers which is easily adapted to typical containers without changing either the shape or the structure of the typical containers, which is easily put to practical use, and which may be efficiently used in mass production.

It is still another object of the present invention to provide a container with a structure for detachable coupling of containers which can be produced in mass production by a simple process and with low cost due to its simple construction.

It is still another object of the present invention to provide a container with a structure for detachable coupling of containers which saves cost since its coupling structure, while achieving the above objects, nevertheless causes no or very little increase of the amount of material used in the container.

It is still another object of the present invention to provide a container with a structure for detachable coupling of containers, in which the coupling structure is hygienically favorable to a person drinking from the contained beverage while directly touching the predetermined position of the flange of the container with his or her lips.

It is still another object of the present invention to provide a container with a structure for detachable coupling of containers, which coupling structure gives no or little bad influence upon the structural strength of the container because the coupling structure does not comprise a portion slitted into the container body, a portion welded on the container body, or a portion riveted into the container body.

SUMMARY OF THE INVENTION

In order to accomplish some or all of the above objects, the present invention provides a container with complementary detachable coupling structures on opposite ends such that a container may be detachably coupled with similar containers at both ends. On a first end of the container is a perimeter structure extending longitudinally beyond the center of the end face of the container, such that the perimeter structure has a perimeter inner diameter. On the second end of the container is an extended end structure with an end outside diameter smaller than the inner diameter of the perimeter structure on the first end. To detachably couple two containers each possessing the two structures, the extended end structure on the second end of one container is inserted into the perimeter structure on the first end of the other container in a manner which engages complementary detachable coupling mechanisms of the respective structures. The containers are detached by disengaging the respective complementary structures and withdrawing the extended end structure of one container from the perimeter structure of the other container.

In accordance with a first embodiment of the invention, a first container having each of the above described complementary structures is detachably coupled to a second container also having each of the above described complementary structures. The structure at the first end of the first container includes one or more radial protrusions which, when the two containers are longitudinally aligned and inserted together, as described above, engage corresponding circumferentially oriented voids or depressions in the complementary structure on the second end of the second container. Upon aligning the containers to engage the respective structural features, rotating the two containers in opposite directions with respect to the longitudinal axis of the containers, and further engaging the radial protrusions of the first container with the corresponding voids or depressions of the second container, the two containers are securely coupled. The coupling of the containers is detached by rotating the containers in directions with respect to each other which are opposite from the directions used for engaging the containers, and withdrawing the inserted extended end structure of one container from the perimeter structure of the other container.

In accordance with a second embodiment of the invention, a first container has an extended end structure on a first end of the container, the extended end structure has a first outer diameter, and the first container having a ridge around the outer periphery of the extended end structure, the ridge having a second outer diameter which is larger than the first diameter. A first container is detachably coupled to a complementary perimeter structure on a second end of a second container. The perimeter structure, having a first inner diameter, includes flexible protrusions extending radially inwardly from the inner surface of the perimeter structure toward the center of the container, thereby creating a flexible opening with a second inner diameter that is smaller than the first inner diameter of the perimeter and smaller than the second outer diameter of the ridge on the extended end structure. Upon aligning and inserting the extended end structure of a first container into the flexible opening of the perimeter structure of a second container, the ridge around the extended end structure contacts the flexible opening. By applying sufficient force, the flexible protrusions defining the inner diameter are bent until the ridge is forced into and through the flexible opening of second inner diameter. Once the entire thickness of the ridge has passed through the flexible opening, the flexible protrusions either re-extend to their original, undeformed state, if the second inner diameter is larger than the first outer diameter of the extended end structure, or they extend inward until they contact the extended end structure at the first outer diameter. The coupling of the containers may be detached by forcibly withdrawing, against the resistance of the flexible protrusions, the inserted extended end structure of the first container from the perimeter structure of the second container.

The detachable coupling of containers, according to either embodiment of the present invention, may be repeatedly performed without damage to the respective structures or the containers. A plurality of containers may be detachably coupled by attaching additional containers at either end of previously coupled containers, according to both of the two embodiments.

BRIEF DESCRIPTION OF THE DRAWINGS

The above and other objects, features, and other advantages of the present invention will be more clearly understood from the following detailed description taken in conjunction with the accompanying drawings.

FIG. 13A is a partially enlarged sectional view of two containers coupled together according to the embodiment of a container shown in FIG. 12.

FIG. 13B is a partially enlarged perspective and sectional view of a container according to the embodiment of a container shown in FIG. 12.

DETAILED DESCRIPTION OF THE PREFERRED EMBODIMENTS

The First Example of the First Embodiment

Figure 1:
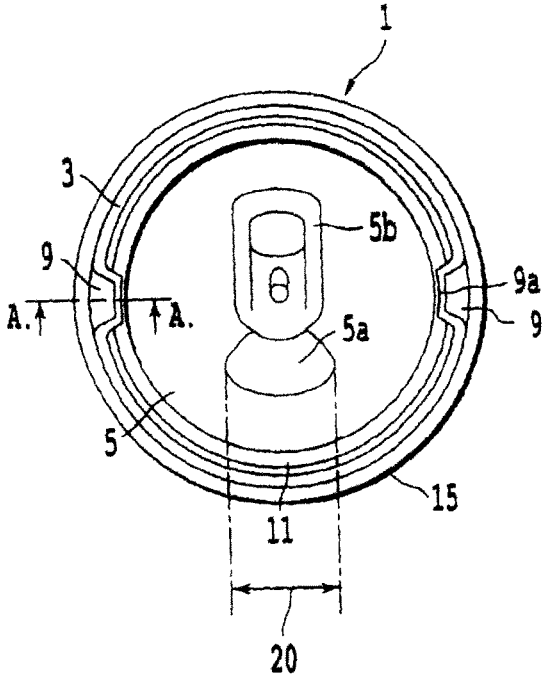
FIG. 1 is a top view of a first example of a can with a structure for detachable coupling of containers in accordance with a first embodiment of the present invention.
Figure 2:
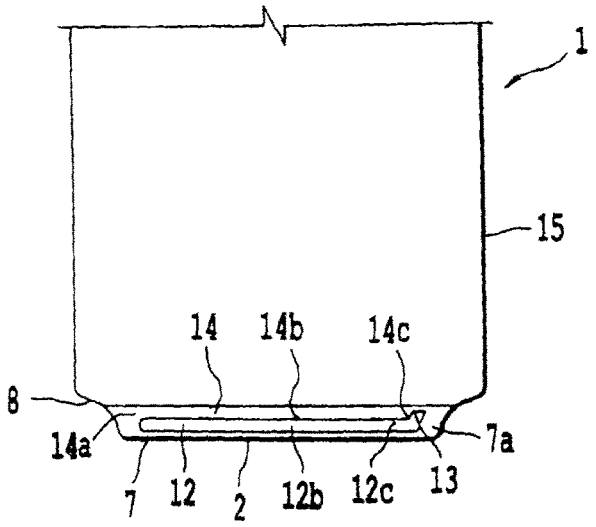
FIG. 2 is a side view of the bottom of the can of FIG. 1.
Figure 3:
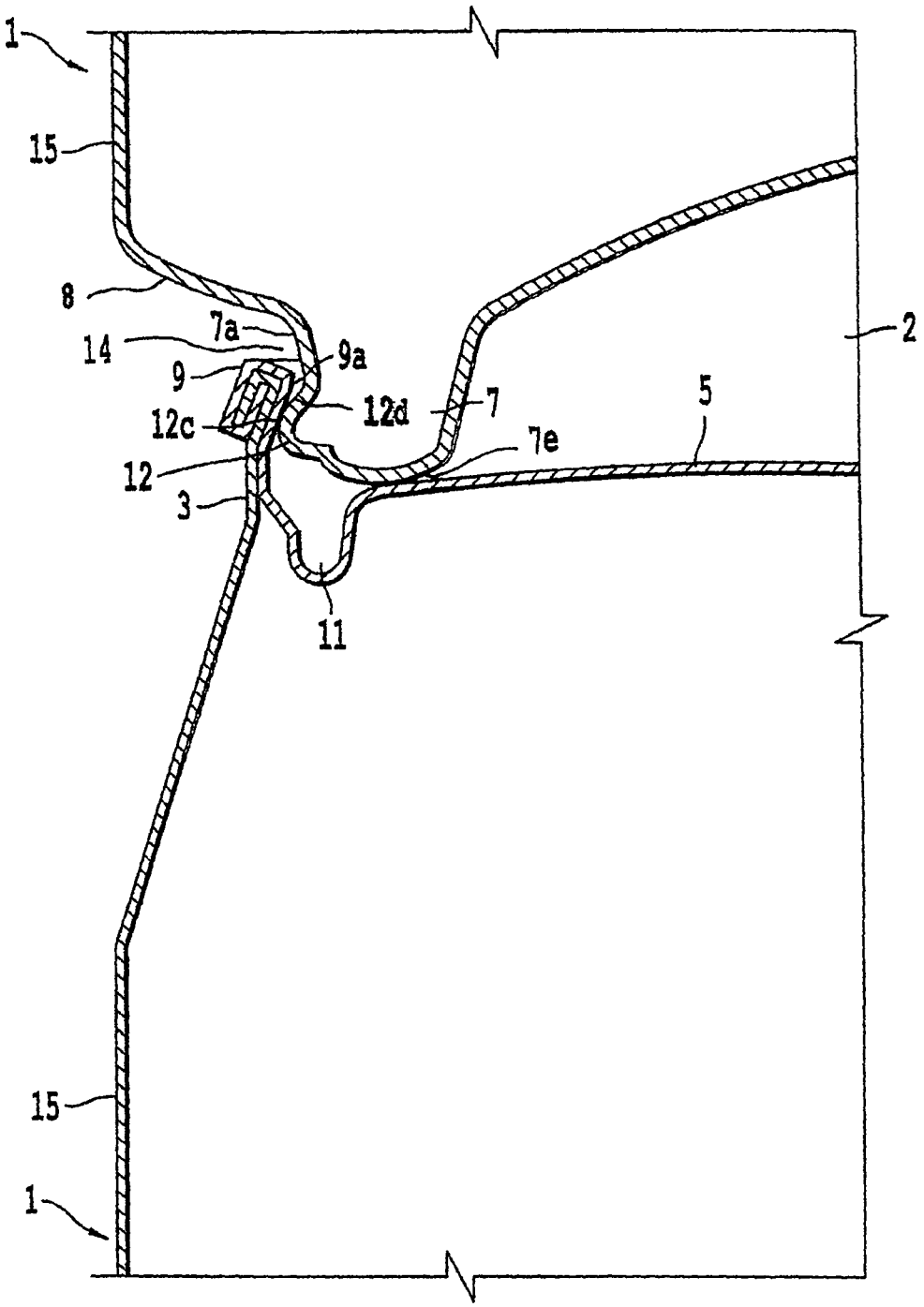
FIG. 3 is a partially enlarged sectional view of two cans of the first example of the first embodiment, as in FIG. 1, showing the coupled state of the cans.
Figure 4:
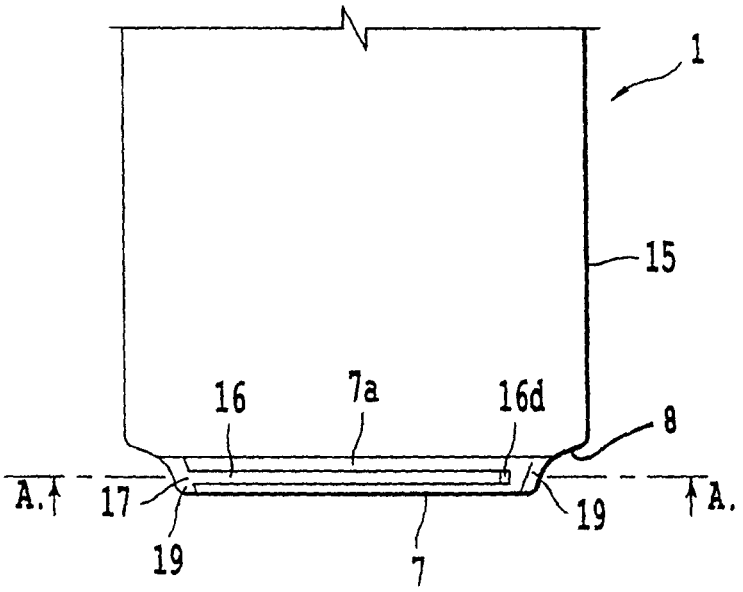
FIG. 4 is a side view of the bottom of a second example of a can with a structure for detachable coupling of containers in accordance with the first embodiment of the present invention.
Figure 5:
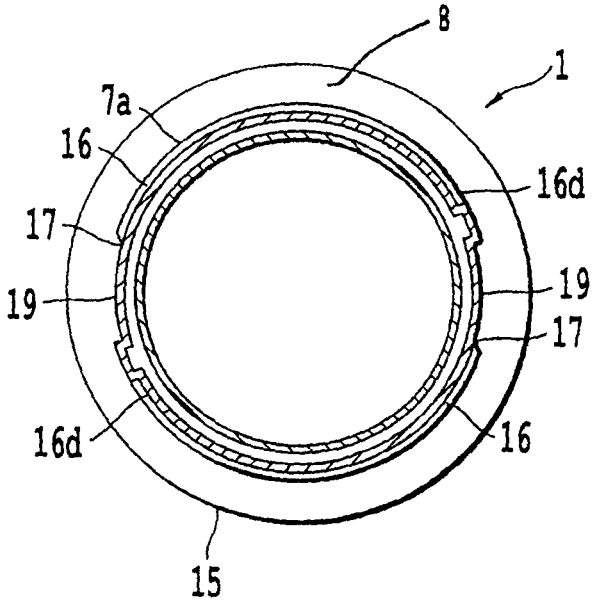
FIG. 5 is a bottom view of the can of FIG. 4.
Figure 6A:
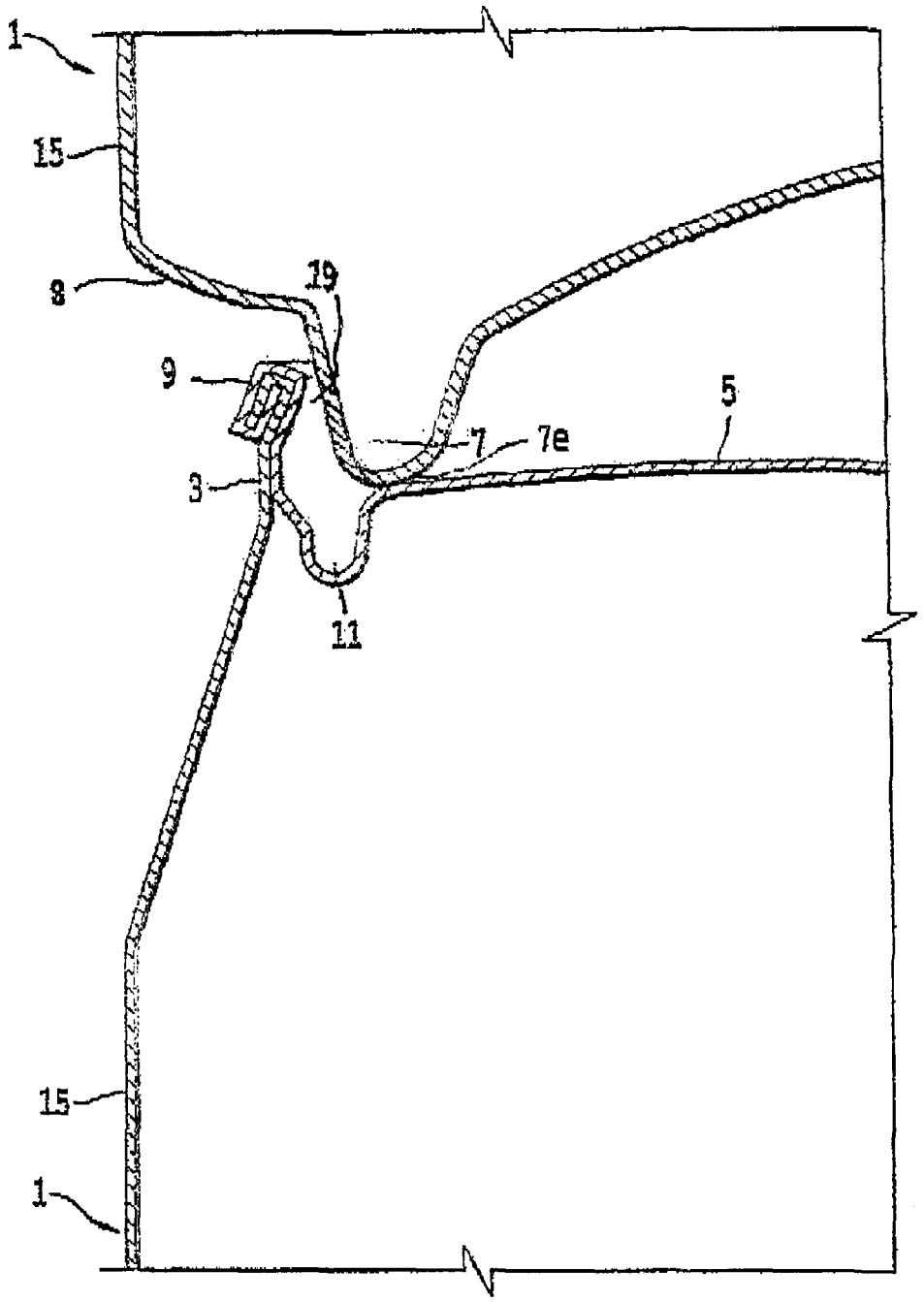
FIG. 6A is a partially enlarged sectional view of two cans of the second example of the first embodiment, as in FIG. 4, showing the flared section of the flange of a second can located in the recessed area of the peripheral wall of a first can when the first can may be inserted concentrically into the center area of the flange of the second can only if the recessed areas are aligned with the flared sections.
Figure 6B:
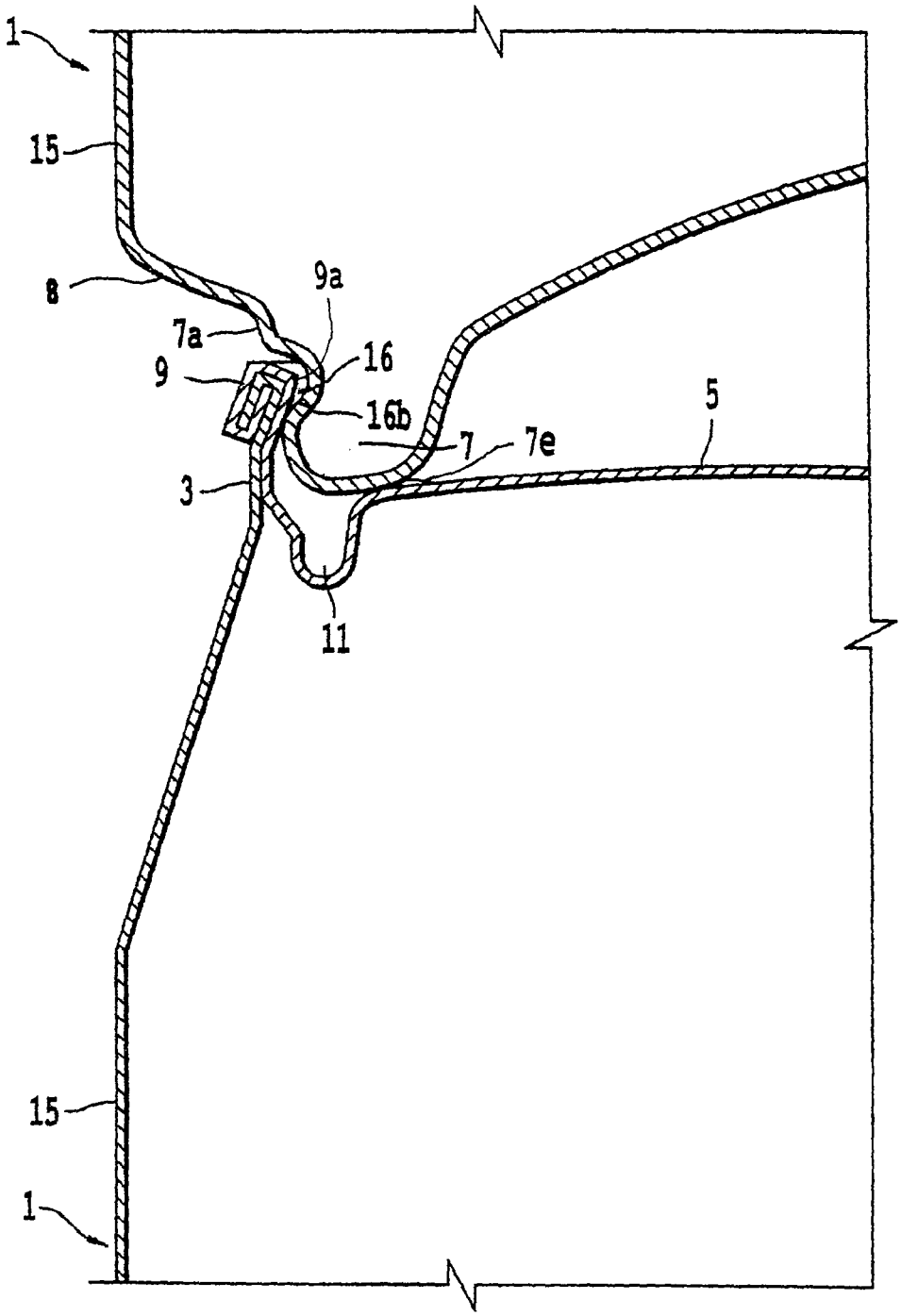
FIG. 6B is a partially enlarged sectional view of two cans of the second example of the first embodiment, as in FIG. 4, showing the coupled state of the cans.

With reference to FIGS. 1 to 3, parts shown in multiple figures have the same identifier in each figure, and where an identifier is shown in multiple figures it is intended to identify the same part in each figure. FIGS. 1 to 3 show a can 1 with a structure for detachable coupling of cans in accordance with a first example of a first embodiment of the present invention. The can 1 comprises a main body 15, a top 5, and a bottom with a peripheral wall 7. A flange 3 is an upstanding peripheral flange around the top 5 at which the top 5 and the main body 15 are seamed together. At the internal base of the flange 3 is a trough 11, at the base of the flange 3, into which small amounts of liquid on the top 5 of the can 1 settle. The top 5 includes an opening or removable tap 5*a* that is nearest to the flange 3 at a pouring section 20 where the user's lips would touch the can 1 when drinking a liquid. A tap handle 5*b* , used for opening the removable tap 5*a* , is attached to the top 5. The flange 3 extends upward a distance from the surface of top 5. The flange 3, has a flange inner diameter which is shown in FIG. 1 with flared sections 9 radially flaring inwardly toward the center of the top 5. Each of the flared sections 9 is formed by bending a section of the flange 3 inwardly toward the center of the top 5 such that the innermost points of the flared sections 9 are inward faces 9*a* . The distance between the inward faces 9*a* defines a flare inner diameter. FIG. 1 is an example of the first embodiment with only two flared sections 9 in the flange 3. However, the use of more flared sections 9, formed to have the same flare inner diameter, is possible. As can be seen in FIG. 1, the flare inner diameter is smaller than the flange inner diameter.

As shown in FIG. 2, at the bottom end of the main body 15 of the can 1 is the peripheral wall 7 extending from a shoulder 8 to an end face 7*e* . The peripheral wall 7, comprises an outer wall surface as shown from the side view in FIG. 2, and an inner peripheral wall surface. Both the inner and outer wall surfaces of peripheral wall 7 are shown in cross section in FIG. 3. The outer surface has a sloping profile from the shoulder 8 to the end face 7*e* with a smaller outer diameter than the main body 15. Instead of sloping, the profile of the outer wall surface may be substantially parallel to the main body of the can. A center area 2, inside the peripheral wall 7 at the bottom end of the can 1, is recessed from the end face 7*e*.

At equally spaced positions disposed around the outer surface of the peripheral wall 7, ridges 12 extend circumferentially around a portion of the outer surface of the peripheral wall 7. The number of the ridges 12 corresponds to the number of the flared sections 9 on the top 5 of the can 1. In the example shown in FIG. 1, two ridges 12 at the bottom of can 1 correspond to the flared sections 9. Each of the ridges 12 is of at least approximately the same shape and size, so only one ridge will be described herein. The ridges 12 run at least approximately parallel to and below the shoulder 8 along the outer surface of the peripheral wall 7 so as to define a void area 14 between the ridge 12 and the shoulder 8. The void area 14 (i.e. groove) has an outer diameter smaller than the outer diameter of the ridges 12 and the main body 15.

At one end of each ridge 12 (shown as the right end in FIG. 2), a short segment 13 of the ridge 12 turns sharply upwardly toward the shoulder 8 so as to form an L shape in the end of the ridge 12 and to create an ending point 14*c* of the void area 14. The short segment 13 may be separated from the main part of the ridge 12 but still positioned to terminate the length of the void area 14. At a ridge mid-point 12*b* along the length of the ridge 12 is a void mid-point 14*b* of the void area 14. At the other end of the void area 14 formed by the adjacent ridge 12 is a receiving point 14*a* of the void area 14. At a position adjacent to the end of the ridge 12 and the receiving point 14*a* , a section 7*a* of the peripheral wall 7 may have the regular sloping profile shown in FIG. 2 without any of the ridges 12.

As shown in FIG. 3, which is a cross sectional view at the plane A-A of the can 1 of FIG. 1, the ridge outer diameter of the ridges 12 is greater than the outer diameter of the peripheral wall 7 within the void area 14. The flare inner diameter, between the inward faces 9*a* shown in FIG. 1, is about the same as the outer diameter in the void area 14 and smaller than the outer diameter around the ridges 12.

When a first can 1 is longitudinally aligned end-to-end with a second can 1 according to FIG. 3 such that the flared sections 9 of the first can 1 are aligned with the wall sections 7*a* , and the peripheral wall 7 of the second can is inserted concentrically into the interior of the flange 3 of the first can 1, the end face 7*e* of the peripheral wall 7 of the second can 1 is near to or touching the top 5 of the first can 1. If the cans 1 are appropriately rotated in opposite directions with respect to each other, the flared sections 9 will enter the receiving points 14*a* . As the rotation continues, the flared sections 9 of the first can 1 move toward the ending points 14*c* of the second can 1. Since the flare inner diameter between the inward faces 9*a* is smaller than the outer diameter of the ridges 12, the cans, having been rotated into this position, cannot be pulled longitudinally apart without first reversing the rotation of the cans such that the flared sections 9 return to the wall sections 7*a* , to release the flared sections 9 from the void areas 14.

At the void ending point 14*c* , near the short section 13, a locking section 12*c* of each ridge 12 is created by a change in the shape or position of that ridge 12 to increase the frictional contact between that ridge 12 and the corresponding flared section 9, or between other parts of the structure. The locking position 12*c* secures the detachable coupling of the cans until sufficient reverse rotational force is applied to overcome the frictional resistance created by locking position 12*c* . The secure detachable coupling allows multiple cans 1 to be carried easily without the cans 1 becoming unintentionally detached.

Alternatively, the locking portion 12*c* of the first example of the first embodiment may have at least one protuberance to create an increased frictional resistance in the locking portion 12*c* . Instead, near the position of the locking portion 12*c* , the ridge 12 may have a swell for increased friction to prevent unintended decoupling by reverse rotation under a small force. Further, each ridge 12 may have a number of prominences on outer surface of the ridge 12 to increase the frictional resistance in either direction of rotation with respect to the corresponding flared section 9 of a first can 1.

Second Example of First Embodiment

A stack of vertically adjacent cans without interlocking the adjacent cans is commonly used by manufacturers and stores to save space and/or display beverage cans that may be easily separated. Thus, stacking, without interlocking, adjacent cans provides an important aspect to the commercial value of beverage containers.

In the second example of this embodiment, the coupling structure permits stacking in two ways: with interlocking cans and without interlocking cans. Thus, stacking with or without interlocking cans allows manufacturers and stores, for example, to save space and/or display the cans that may be easily separated.

The second example of the first embodiment uses the same structure at the top end of the can 1, shown in FIG. 1, as the first example of the first embodiment. However, rather than using the bottom structure shown in FIGS. 2 and 3, the second example uses a bottom structure shown in FIGS. 4-6B.

To simplify the description of the second example, the structure shown in FIGS. 4-6B will be described with reference to the first example of the first embodiment. In the first example, the outside diameter of the peripheral wall 7 is smaller than the inside diameter at the inward faces 9*a* of the flared sections 9, and the ridges 12, protruding from the outer surface of the peripheral wall 7, have a larger outside diameter than the peripheral wall 7.

In the second example of this embodiment, the outer diameter of the peripheral wall 7 is larger than the flare inside diameter. However, in the second example, void areas 16, with receiving areas 17 and end points 16*d* , circumferentially extend around the peripheral wall 7 to accommodate the corresponding flared sections 9. Areas 19 are recessed into the peripheral wall 7, between the end face 7*e* at the bottom and the shoulder 8 at the top, in an area wide enough to accommodate the width of the flared sections 9. Thus, the peripheral wall 7 of a first can 1 may be inserted concentrically into the center area of the flange 3 of a second can 1 only if the recessed areas 19 are aligned with the flared sections 9. In addition, the void areas 16 of the second example are recessed into the surface of the peripheral wall 7 such that, with the appropriate rotation described with respect to the first example, the flared sections 9 enter the void areas 16 to detachably couple the respective cans 1.

In the first example, as shown in FIG. 3, an upper surface 12*d* of each ridge 12 contacts the corresponding flared section 9 when the cans 1 are coupled together. In contrast, in the second example, a sloping surface 16*b* of each void area 16 contacts the inside of the corresponding flared section 9.

In addition, the downward slope of lower surface 16*b* allows dirt or other particles to easily fall out of the circumferential voids 16. Accordingly, the circumferential voids 16 are unlikely to contain particles that could interfere with the insertion of flared sections 9 into the circumferential voids 16.

Further, the recessed areas 19 at the front side of the receiving area 17 of the void area 16 (i.e. groove 16) allow for over-sized heights of flared sections 9 of a variety of manufactured beverage cans 1. Thus, a variety of different sized cans 1 can be stacked together and save space and/or be displayed and also be easily separated.

Third Example of First Embodiment

The third example of the first embodiment, like the first and second examples, is a container having structures at both ends for the purpose of detachable coupling of at least two containers. Also, as in the prior examples, after a first and second container are longitudinally aligned, a structure on a first end of the first container is inserted into a structure on a second end of a second container, a protrusion from an inner diameter of the structure on the second end of the second container engages a void on an outer diameter of a structure on the first end of the first container, and, by appropriately rotating the respective containers in opposite directions, the protrusion on the second container further engages the void on the first container to provide a secure detachable coupling of the containers.

In this example, the container may be a plastic bottle or can. However, a container 51 will be described in the context of a plastic bottle having a top portion with an opening 65 and a top outer diameter that is smaller than the diameter of the main body of the container 51. The outer surface of the top portion is threaded with a spiral thread 66 around the outside of the top portion over a height 61*h* , such that a cap 52, having a corresponding threaded protrusion on its inside perimeter face, can be placed over and rotated (screwed) onto the outside surface of the bottle top down to a cap band 52*p* allowing the cap 52 to be securely fastened to seal the top of the container 51 in a well known manner. The outer surface of the cap 52 has a spiral thread 64, similar to the spiral thread 66, running spirally around the cap 52.

Figure 14:
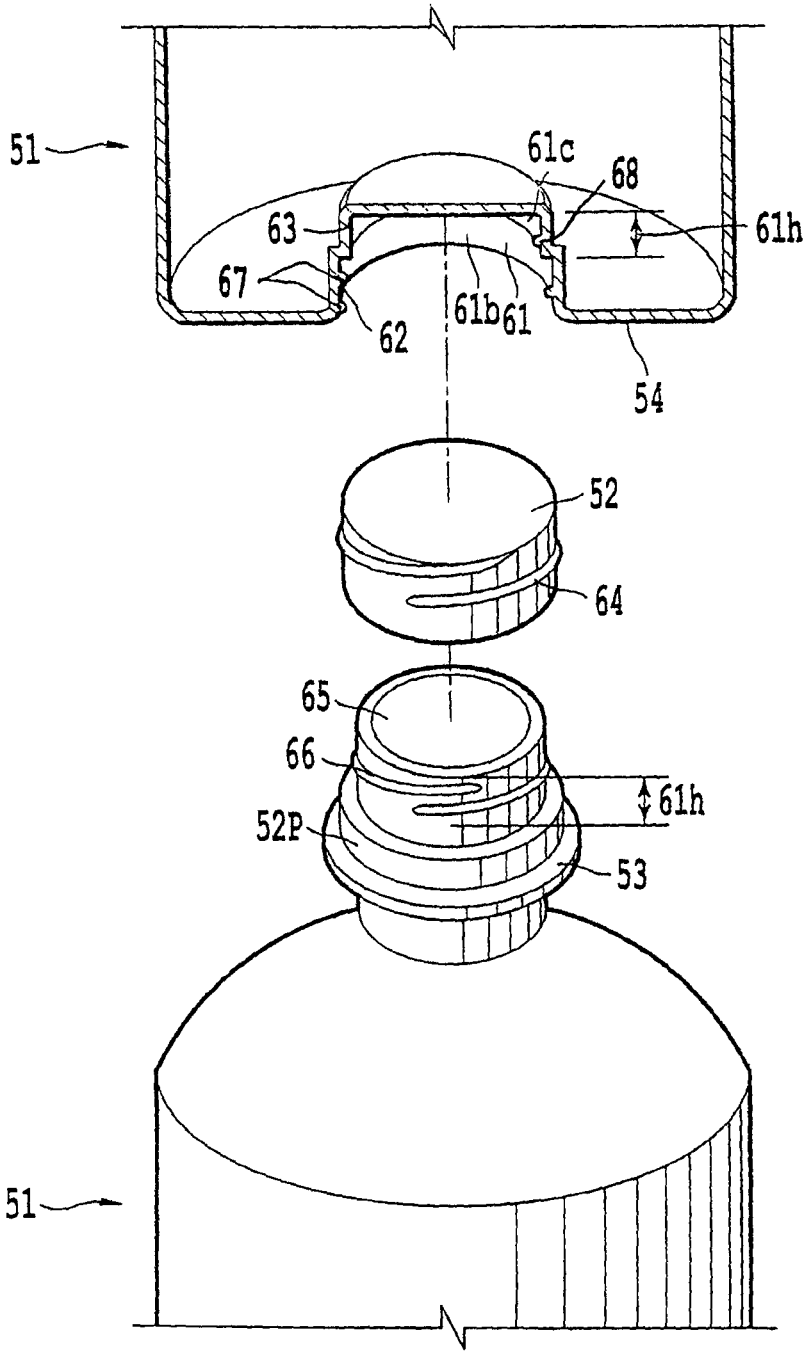
FIG. 14 is a sectional view of a first container and a perspective view of a second container in a third example according to the first embodiment of the present invention.

On a bottom 54 of the container 51 in the third example, shown in cross-section in FIG. 14, is a cavity 61 with a cylindrical shape having a first region 61*b* and a second region 61*c* . The cavity 61 extends up into the internal volume of the bottle from the center of the bottom 54. Both of the regions, 61*b* and 61*c* , having an inside wall 63 and at least one threaded protrusion extending inwardly from their inner surfaces. The inside wall 62 of the first region 61*b* has at least one threaded protrusion 67 that is complementary to the thread 64 on the outer surface of the bottle cap 52, and it has an inside diameter such the bottle cap 52 may be screwed into the first region 61*b*.

The second region 61*c* extends deeper into the internal volume of the container 51 from the innermost depth of the first region 61*b* . The inside wall 63 of the second region 61*c* has a threaded protrusion 68 complementary to the thread 66 on the outer surface of the top portion of the container 51, and it has an inside diameter such that the top portion of the container 51 may be screwed into the second region 61*c*.

According to the third example of the first embodiment, a first container 51 and a second container 51 may be connected by a structure in which the cap 52 attached to the first container 51 is screwed into the first region 61*b* of the second bottle. Alternatively, a first container 51 and a second container 51 may be connected by a second structure in which the top portion of the first container 51, without the cap 52, is screwed into the second region 61*c* of the second bottle.

The total depth of the cavity 61 is approximately the sum of the depth 61*h* of the first region 61*b* and the depth of the second region 61*c* . Since the outer diameter of a rim 53 is larger than the outer diameter of the cap 52, the rim 53 will not fit into the first region 61*b* . Thus, if the maximum depth of the cavity 61 is greater than the distance from the rim 53 to the opening 65 of the top portion of the container 51, the rim 53 will stop further progress when it strikes the bottom surface 54 of the container 51. The total depth of the cavity 61 is shared between the first region 61*b* and the second region 61*c* so each region will be able to engage enough of the threads 64 and 66 to provide a secure, detachable coupling between the first and the second bottles 51 either with or without the cap 52.

In another particular case, the first region 61*b* may also be used as a mouth diameter region when a top portion of a container 51 is suitable to couple with the mouth diameter region or when the top portion of the container 51 has a thin cap 52 or a resilient spiral thread 66.

Additionally, the second region 61*c* may used, for example, to allow an object on the cap of a second container, such as a straw or a statuette, to be inserted into an insertable region of the cavity of the container 51.

The cavity 61 may be limited to either the first region 61*b* or the second region 61*c* , rather than the combination described above.

Figure 15:
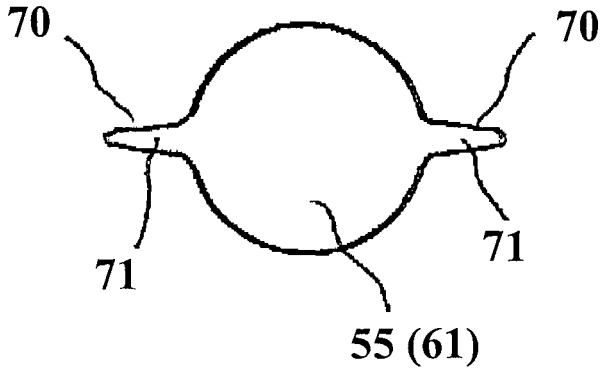
FIG. 15 is a bottom view of a cavity for receiving a top portion of a second container, showing only a selected part in which the cavity and a cavity of each of at least one rib of the cavity wall are joined, in accordance with a third example of a first embodiment of the present invention.

FIG. 15 shows the wall of cavity 61 or 55 of the bottom 54 of the container 51 having a pair of ribs 70. The ribs 70 may be formed in a well known manner by a mold. The mold may have a center which helps to form cavity 71 as well as cavity 61 or 55, which exists at the center of bottom 54 of the container 51 for receiving the cap portion of the second container 51.

The ribs 70 may be formed in various shapes by using variously shaped or positioned molds.

The ribs 70 connect with a side wall of the cavity 61 or 55 that exists at the center of the bottom 54 of the container 51. Thus, the cavity 71 of the rib 70 is able to join with the cavity 61 or 55 and can be used, for example, to release air or liquid that may remain in the coupled second container 51 when the second container 51 is coupled without cap 52 being closed. Furthermore, when the rib 70 extends to the top of the cavity 61 or 55 of the bottom 54 that receives the cap portion or the top portion of the second container 51, then air or liquid in the coupled second container 51 escapes through the cavity 71 of rib 70 more easily.

The First Example of the Second Embodiment

Figure 7:
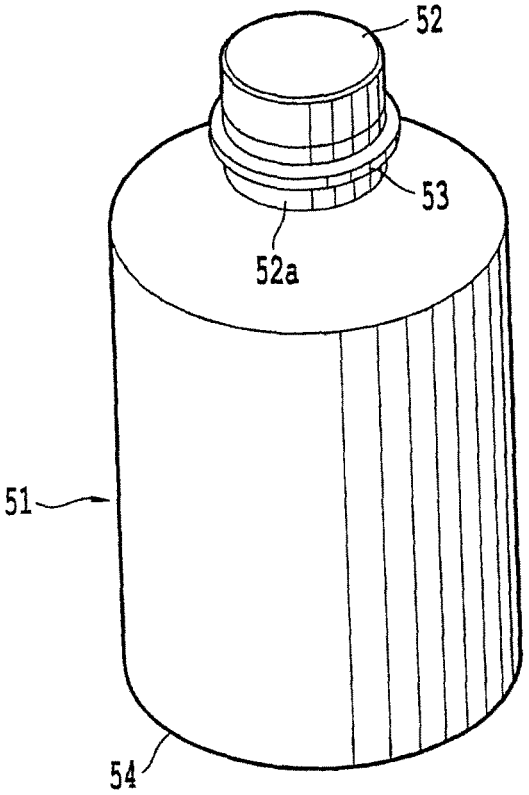
FIG. 7 is a perspective view of a first end of a container with a structure for detachable coupling of containers in accordance with a first example of a second embodiment of the present invention.

FIG. 7 shows a perspective view of a top of the container 51 according to the first example of the second embodiment. The top portion of the container includes the removable cap 52 and a neck 52*a* , with both the cap 52 and the neck 52*a* having an outside dimension that is smaller than the main body 51. The neck 52*a* extends up from the main body of the container 51 to the rim 53, which protrudes radially outward from the outer periphery of the top portion at a position above the neck 52*a* , as shown in FIG. 7, and a portion of the neck 52*a* , having a smaller outside dimension than the rim 53, extends below the rim 53 to the main body.

Figure 8:
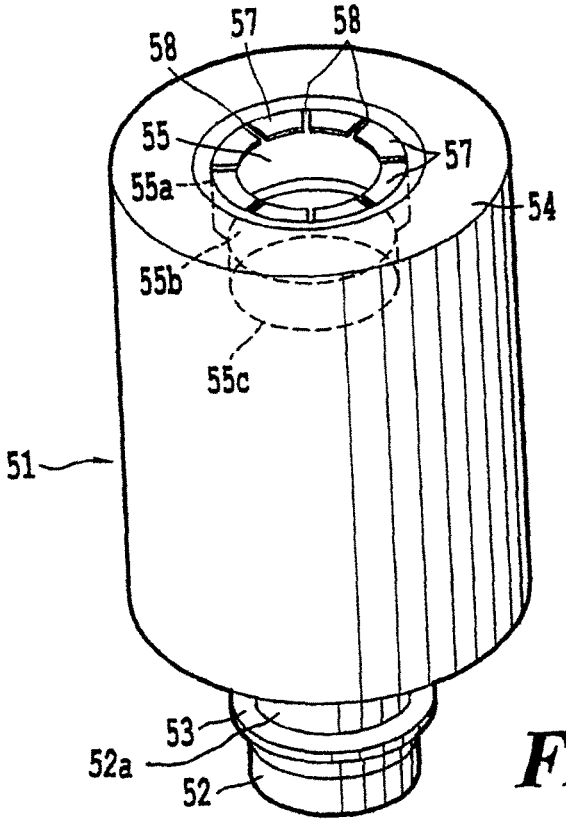
FIG. 8 is a perspective view of the second end of a container with a structure for detachable coupling of containers in accordance with a first example of a second embodiment of the present invention.

FIG. 8 shows a perspective view from a bottom of the container 51 according to the first example of the second embodiment, including the outline of the cavity 55 in the container bottom 54. The diameter of the cavity 55 at an interior wall 55*a* is larger than the outside dimension of the rim 53. At the opening of the cavity 55, extending in approximately a same plane as the bottom 54, flexible protrusions or tabs 57 extend radially inward toward the center of the bottom 54, collectively forming a resilient flexible opening that is smaller than the outer dimension of the rim 53. The tabs 57 may be made of a same material as the container, or may consist of a different material than the container. In either case, the tabs 57 may be formed by casting, attached by gluing, welding or other techniques, or fitted to the other elements of the structure. The number of tabs 57 forming the flexible opening may vary. There is a gap 58 between adjacent tabs 57.

Figure 9:
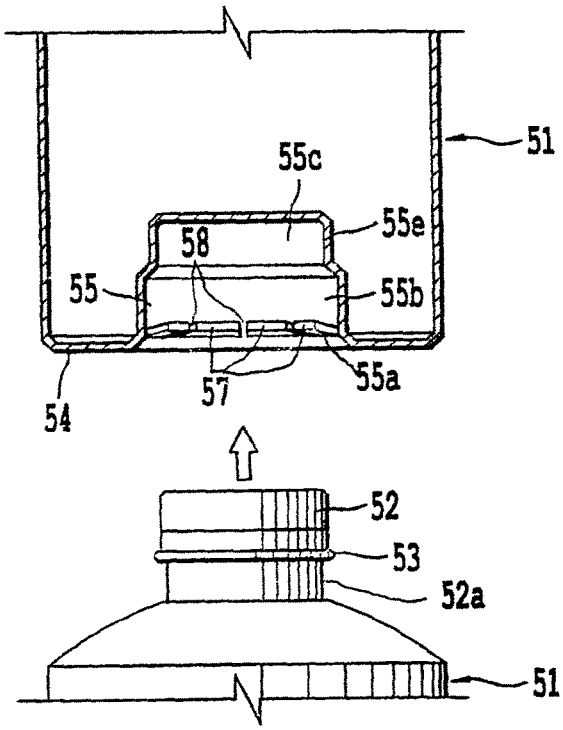
FIG. 9 is a sectional view of two containers according to FIG. 7 in a near coupled position.
Figure 10:
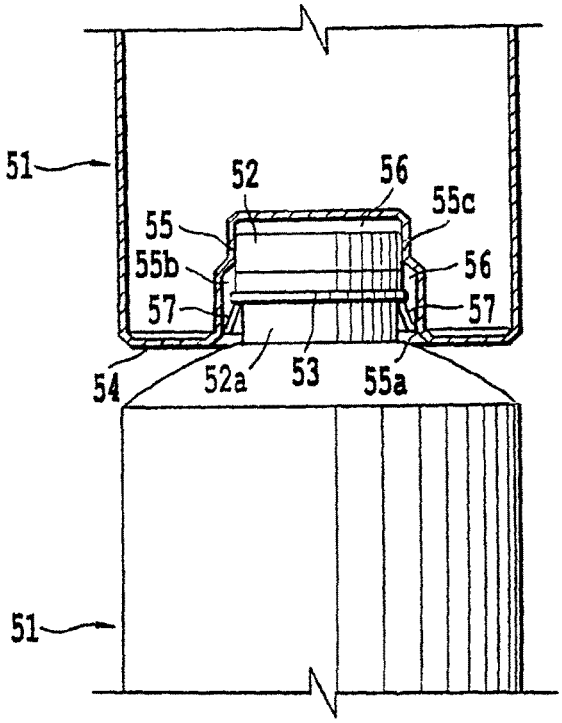
FIG. 10 is a sectional view of two containers according to FIG. 7 detachably coupled according to the first example of the second embodiment.

According to this example, the containers are coupled by longitudinally aligning (i.e., aligning the longitudinal axes of) them, as in FIG. 9, and inserting the top portion of a first container 51 into the cavity 55 in the bottom 54 of a second container 51, as in FIG. 10. As the top portion of the first container 51 is inserted into the flexible opening, the rim 53 comes into contact with the tabs 57. When sufficient force is provided, the tabs 57 are deflected inward (into the cavity 55) and the rim 53 will push into the flexible opening. The gaps 58 between the respective tabs 57 allow air, otherwise trapped inside the cavity 55 when a top portion of the container 51 is inserted, to escape when the containers are pushed together. The inner diameter and the depth of the cavity 55 are large enough to allow the rim 53 and the top portion, including the cap 52, above the rim 53 to enter the cavity 55 far enough that the rim 53 pushes past the tabs 57. The cavity 55 may include an outer region 55*b* having a diameter large enough to fit the rim 53, and an inner region 55*c* having a diameter only large enough to fit the cap or top portion above the rim 53. Reserve space 56 in each of the outer region 55*b* and the inner region 55*c* , provides the room needed so the rim 53 can push past the flexible tabs 57 when the tabs 57 bend into the cavity 55. Additionally, the reserve space 56 may, for example, allow an object on the cap of the second container, such as a straw or a statuette, to be inserted into an insertable region of the cavity of the first container 51.

In general, as shown in FIGS. 8-10, the inside profile of cavity 55 conforms to the outside profile of the top portion, except for the reserve space 56. The reason for this will be explained in more detail below.

Once the rim 53 has been forced through the flexible opening, the tabs 57 will resiliently rebound, to the extent possible, back toward their undeflected positions in the plane of the bottom 54, but may come to rest against the outside of the neck 52*a* , as in FIG. 10, if the diameter of the neck 52*a* is also larger than the inner diameter of the flexible opening when the tabs 57 are in their undeflected position. The tabs 57 are flexible enough to allow the diameter of the rim 53 to be inserted into the cavity 55 as described above. However, the rigidity of the tabs 57 determines how easily the containers 51 can be attached and detached in the manner described above. Therefore, depending on the material, the tabs 57 may not be rigid enough to prevent the unintentional decoupling of the containers 51 under a small force, or too rigid to allow the easy attachment and detachment of the containers 51. It is preferable that a minimum force necessary to pull the rim 53 through the flexible opening is large enough to provide a secure detachable coupling while still allowing the containers to be pulled apart without a need for excessive effort.

Figure 11:
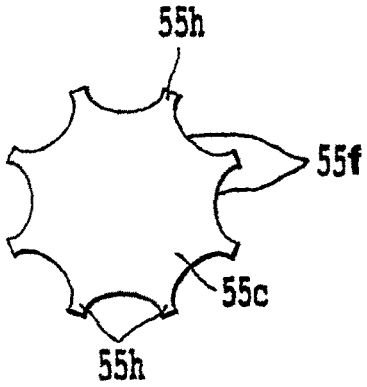
FIG. 11 is a horizontal cross sectional view of an innermost portion of the cavity in a first or a second example of the second embodiment of the present invention.

As stated above, the interior of the cavity 55 conforms closely to the exterior shape of the top portion, such that the top portion fits snugly into the cavity 55. Frictional resistance between the cap 52 and the inner walls 55*e* of the inner region 55*c* of the cavity 55 increases the minimum force required to attach and detach the containers 51. To increase this resistance, the interior walls 55*e* of the cavity 55 may include deformable sections 55*f* , having the horizontal cross section shown in FIG. 11, such that the inner diameter defined by the deformable sections 55*f* is smaller than the outer diameter of the top portion (i.e. cap 52). Due to the smaller diameter of the deformable sections 55*f* , insertion of the top portion into the cavity 55 requires temporary resilient deformation of the deformable sections 55*f* . The resilient deformable sections 55*f* squeeze the exterior of the top portion, increasing the holding force of the connection, and opposing the unintended withdrawal of the top portion from the cavity 55. The spaces 55*h* between the deformable sections 55*f* allow air, otherwise trapped inside the region 55*c* when a top portion of the container 51 is inserted, to escape from the cavity 55.

Characteristics affecting the rigidity of the tabs 57 also affect the strength of the coupling. For example, varying the composition, number, shape, length, width and/or thickness of the tabs 57 or varying the geometries of the gaps 58 between the tabs 57, affects the strength of the coupling. Similarly, the characteristics of the deformable sections 55*f* affect the frictional resistance provided against insertion, removal, or rotation of the top portion of the containers 51 coupled according to this example. The coupling and decoupling of the containers 51 according to this example may be performed repeatedly without damage to the containers 51 or deterioration of the coupling parts.

Figure 16:
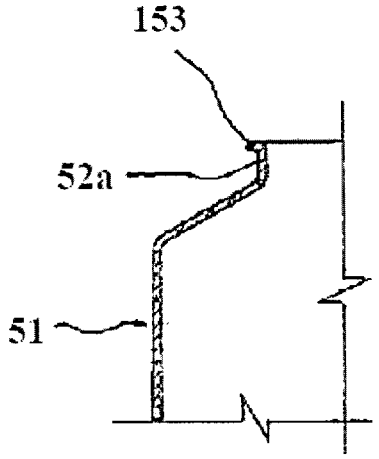
FIG. 16 is a sectional view of a container according to a first example of the second embodiment, showing a rim forming a lip edge of an opening of a container.

FIG. 16 shows a modification in which the rim 53 of the top portion of the container 51 forms a lip edge 153 of the opening 65 (i.e. mouth 65) of the container 51.

Second Example of the Second Embodiment

Figure 12:
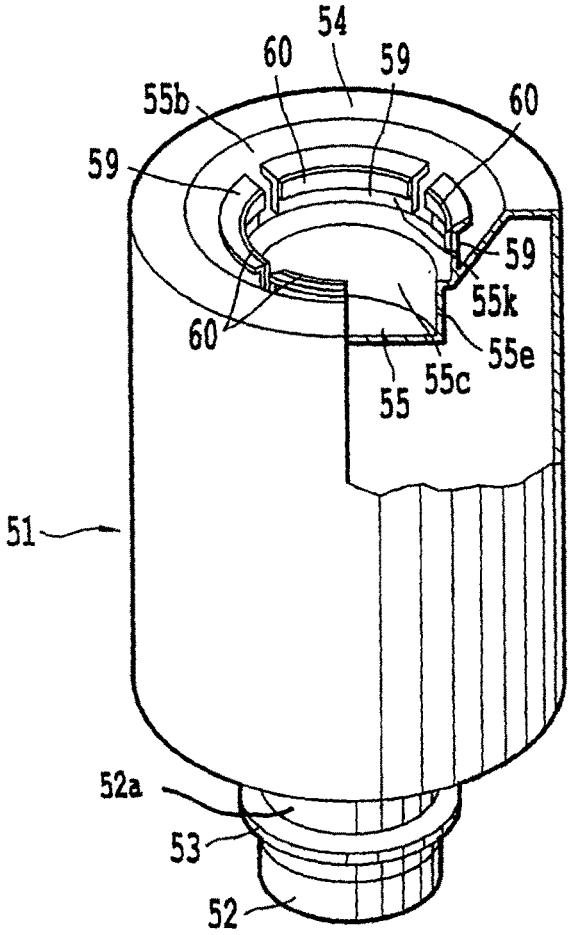
FIG. 12 is a perspective view of a container according to a second example of the second embodiment of the present invention with a partial cutaway sectional view of the container.

In the second example of the second embodiment, the top portion of the container 51 is the same as in the first example of the second embodiment. However, in the structure at the bottom of the container 51 in the second example, shown in a cut-away perspective view in FIG. 12, the tabs 57 of the first example are replaced by flexible flanges 59, which extend from the opening of the cavity 55, into the depth of the cavity 55 along the inside walls of the region 55*b* . A number of the flexible flanges 59 are spaced apart around the inside wall of the region 55*b* . The spaces between the respective flexible flanges 59 allow air, otherwise trapped inside the cavity 55 when a top portion of the container 51 is inserted, to escape when two containers 51 are attached by this structure.

As shown in a partial cross section view in FIG. 13*a* , the flexible flanges 59 include a projection 60 having a tapered face 60*a* such that the flexible flange 59 is thin at the opening of the cavity 55 and becomes gradually thicker with the increasing depth of the outer region 55*b* , until a seated position 55*k* in which the thickness of the flexible flange 59 abruptly becomes thin again. FIG. 13*b* illustrates an example container top portion prior to insertion into the outer region 55*b* of the container illustrated in FIG. 13*a* . As the container top portion is inserted into the outer region 55*b* by moving the container top portion in the direction of the arrow illustrated in FIG. 13*b* , the flexible flanges 59 are gradually deformed in a direction A by the rim 53 until the rim 53 pushes past a thickest portion 60*b* of the flexible flanges 59 into the position 55*k* . As the rim 53 moves past the thickest point 60*b* to the seated position 55*k* , the thickness of the flexible flanges 59 sharply decreases, the diameter of the region 55*b* increases to accommodate the rim 53, the deformed flange 59 moves in a direction B toward the neck 52*a* , and the rim 53 is moved into the seated position 55*k* . The gradually increasing slope of tapered face 60*a* provides gradually increasing resistance as the rim 53 is inserted. However, when withdrawing the top portion from the position 55*k* , a relatively high resistance is immediately encountered at the thickest portion 60*b* of the flexible flanges 59, due to the sharply decreasing diameter encountered when exiting the region 55*k* . Thus, the force required to insert the top portion of the first container 51 into the bottom structure of the second container 51 is much lower than the force required to pull the containers apart. The second example of the second embodiment performs in a similar manner to the first example using another structure and method for securely and detachably coupling containers.

Third Example of the Second Embodiment

Figure 17:
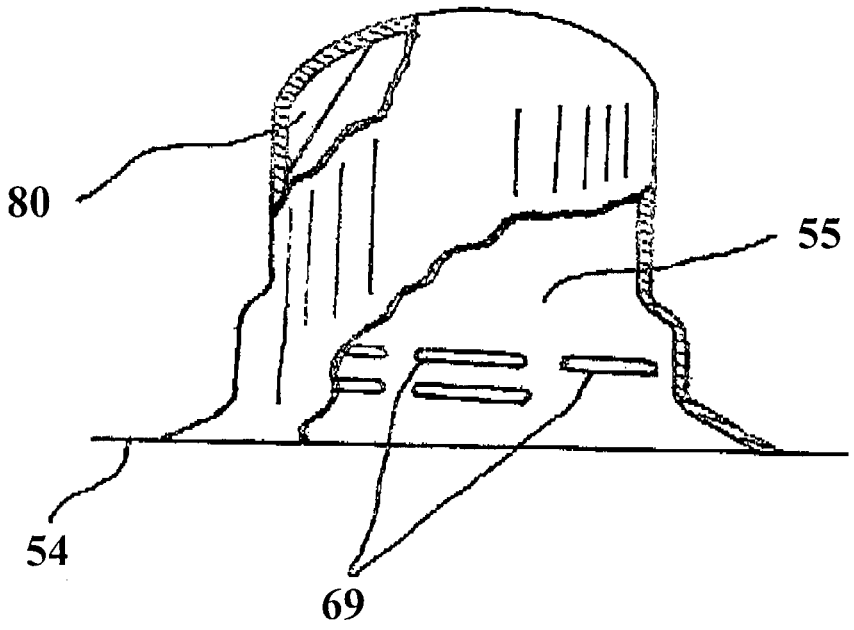
FIG. 17 is a partially enlarged sectional view of a cavity of a modified container of the first example of the second embodiment, showing at least one projection on an inside wall of the cavity and at least one spiral thread of the cavity of a bottom portion.

In the third example of the second embodiment, the structure of container 51 is similar to the container 51 as in the first example of the second embodiment. However, a modification is made, as shown in FIG. 17, in which at least one spiral thread 69 replaces the flexible protrusions or tabs 57 of the cavity 55. Spiral thread 69 may include a broken spiral thread so as to provide at least one gap to allow air or liquid, otherwise trapped, to escape from the cavity or main body of the container 51. For example, when containers are detachably coupled, longitudinally aligned gaps allow air or liquid to escape from the cavity or main body of the container 51.

Figure 18:
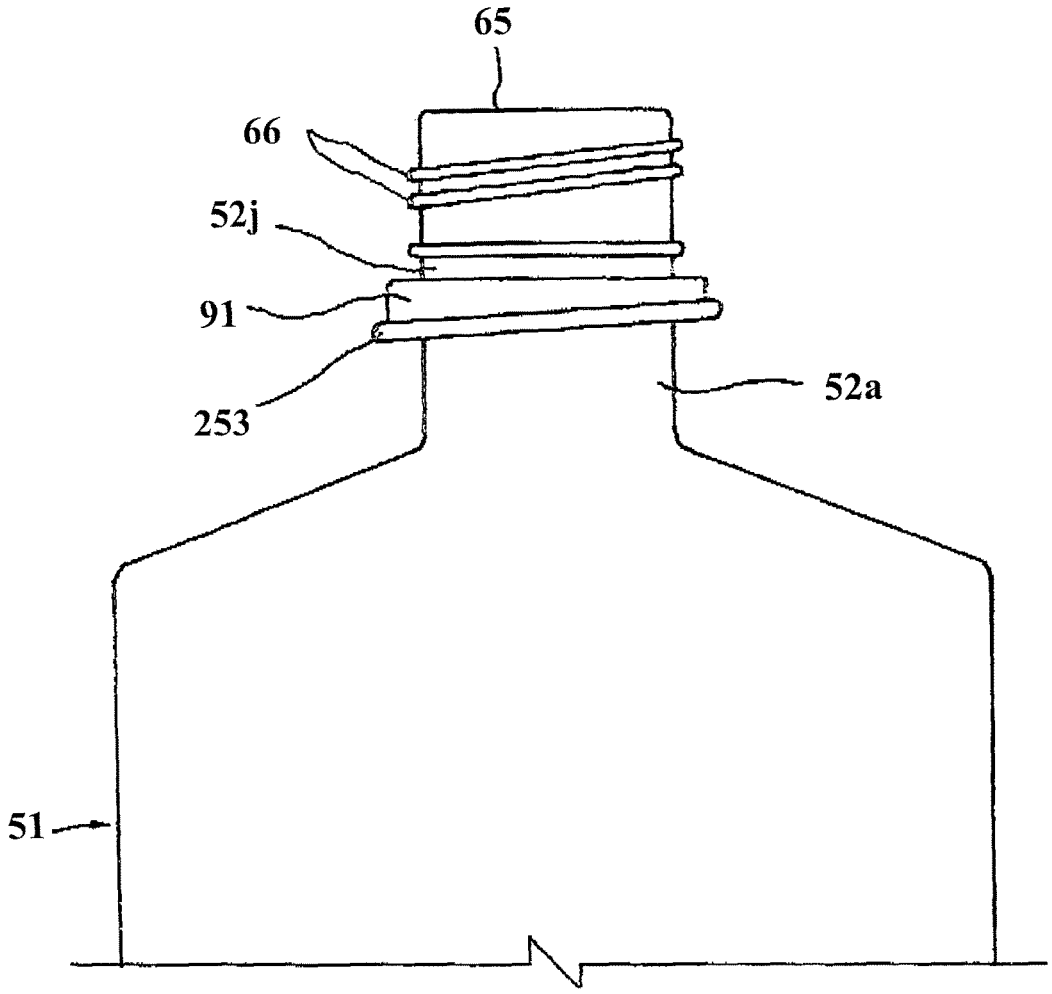
FIG. 18 is a partially enlarged side view of a modified container of the first example of the second embodiment, showing at least one spiral thread of a top portion of a container and an inner part of the at least one spiral thread extending upwardly and forming a rim protruding outwardly from an exterior face of a top portion of the container.

At least one spiral thread 253 of the container 51 corresponds with the at least one spiral thread 69 of the cavity 55, as shown in FIG. 18. The at least one spiral thread 253 replaces the rim 53 of the top portion of the container 51.

In practice, the first and second examples of the second embodiment allow for detachable coupling of the containers 51, whether or not the container 51 has a cap 52.

Furthermore, the inside wall of the cavity 55 of the container 51 has at least one projection 80. As a result, when rotating the containers to detachably couple the first container 51 and the second container 51, the rotation stops upon a top face of the second container 51 reaching the at least one projection 80 on the inside wall of the cavity 55 of the first container 51. Thus, air or liquid in the second container 51 is able to escape while detachably coupled to the first container 51. For an even greater effect, this aspect may be combined with the longitudinally aligned gaps described above to allow air or liquid to escape from the cavity of main body of the container 51.

The inner end wall of the at least one projection 80 may also be tapered, to provide variously sized diameter widths, so that the at least one projection 80 is able to meet different sized diameters of the top face of the second container 51 which may result from having a cap 52 or not having a cap 52. Further, when there are a plurality of projections 80 that are tapered, the plurality of tapered projections 80 reduce or prevent shaking of the detachably coupled second container 51.

Figure 19:
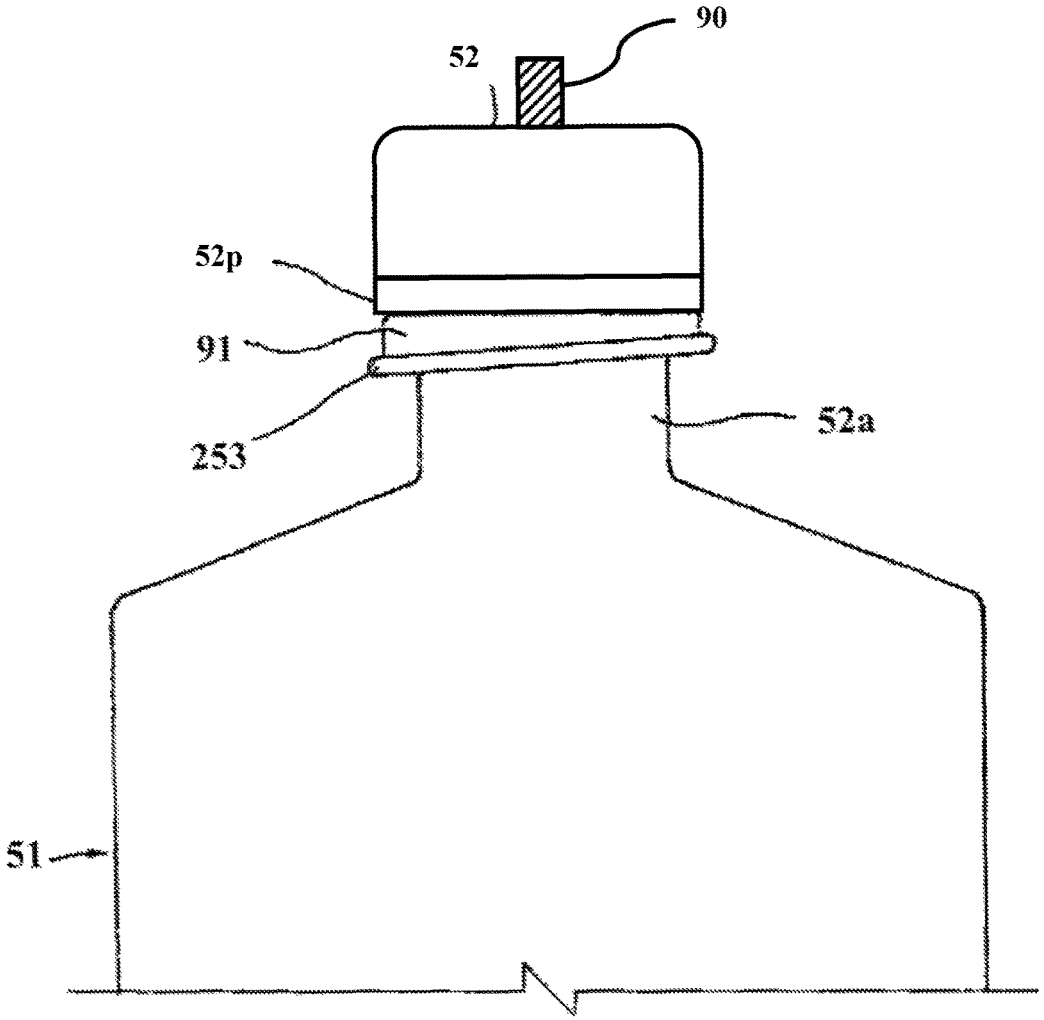
FIG. 19 is partially enlarged side view of a modified container of the first example of the second embodiment, showing a cap including an object.

FIGS. 18 and 19 further show an inner part of the at least one spiral thread 253 extending upwardly and forming a rim 91 protruding outwardly from an exterior face of the top portion of the container 51.

A cap band 52*p* may sit on a cap band seating portion 52*j*.

Although the preferred examples and embodiments of the present invention have been disclosed for illustrative purposed, those skilled in the art will appreciate that various modifications, additions, and substitutions are possible without departing from the scope and spirit of the invention as defined by the accompanying claims.

FIG. 19 further shows a cap 52 including an object 90. As described in the examples of this second embodiment, the object 90 may be, for example a straw (as shown) or a statuette, inserted in a reserve space of the cavity of the container.

What is claimed as new and desired to be secured by Letters Patent of the United States is:

1. A container comprising:

a main body;

a top portion having a narrower diameter than the main body and having an upstanding peripheral flange forming a mouth portion of the container, the upstanding peripheral flange having at least one protrusion extending radially from a surface;

a bottom portion having a peripheral structure, the peripheral structure having an end face, an interior wall facing toward a recessed area, an exterior wall, and at least one groove circumferentially oriented on the interior or exterior wall to receive at least one protrusion of a second container, the at least one groove having a receiving portion which, when aligned with the at least one protrusion of the second container, receives the at least one protrusion of the second container upon rotation of the second container with respect to the container to detachably couple the container and the second container;

at least one outside spiral thread on an exterior wall of the mouth portion;

a cap having at least one cap interior spiral thread to screw the cap onto the mouth portion;

at least one cap exterior spiral thread disposed on an external wall of the cap;

a cap diameter region extending to a first depth in the recessed area in the bottom portion of the container;

at least one first inside spiral thread on an inside wall of the first depth of the recessed area, the at least one first inside spiral thread to receive the at least one cap exterior spiral thread;

a mouth diameter region extending from the first depth to a second depth in the recessed area; and at least one second inside spiral thread on an inside wall of the mouth diameter region, the at least one second inside spiral thread to receive the at least one outside spiral thread on the exterior wall of the mouth portion, wherein the main body extends from the top portion to the bottom portion and the main body, in use, holds liquid, and the inside surface of the mouth diameter region of the recessed area has a groove or gap that allows air or liquid to escape through the groove or gap from a recessed area or a main body of the second container when the container and the second container are detachably coupled and the second container does not have a cap, the groove or gap being formed by a protruding rib of the inside wall, the protruding rib extending a cavity of the groove or gap upwardly in the direction of the top portion of the container, and the protruding rib extending the cavity radially outward beyond a radius of the mouth diameter region.

2. A container comprising:

a main body;

a top portion having an outside diameter smaller than the main body, at least one spiral thread around and protruding outwardly from an exterior face of the top portion, a neck section below the at least one spiral thread having a smaller diameter than the at least one spiral thread, and a cap portion, for receiving a cap, above the at least one spiral thread having a smaller diameter than the at least one spiral thread; and a bottom portion having an end face, and a cavity in the center of the end face, the cavity having an opening into which a top portion and a perimeter rim of a second container can be inserted, and having at least one spiral thread extending inwardly from inside walls of the cavity which, when aligned with at least one spiral thread on an exterior face of the top portion of the second container, receives the at least one spiral thread of the second container upon rotation of the second container with respect to the container to detachably couple the container and the second container, wherein the main body extends from the top portion to the bottom portion, and the main body, in use, holds liquid, and when the at least one spiral thread of the bottom portion receives the at least one spiral thread of the top portion of the second container, the at least one spiral thread of the bottom portion does not receive a cap or cap portion of the second container.

3. The container according to claim 2, wherein:

the at least one spiral thread of the top portion of the container or the at least one spiral thread of the cavity of the bottom portion of the container has an obstructed end, the rotation of the second container with respect to the container to detachably couple the container and the second container stops upon the at least one spiral thread of the cavity of the bottom portion of the container reaching the obstructed end of the at least one spiral thread of the top portion of the second container or the at least one spiral thread of the top portion of the second container reaching the obstructed end of the at least one spiral thread of the cavity of the bottom portion of the container, the cap of the second container includes an object, the object being a straw or a statuette, and the cavity of the bottom portion of the container includes an insertable region such that when the container and the second container are detachably coupled upon reaching the obstructed end, the straw or the statuette is received in the insertable region.

4. The container according to claim 2, further comprising:

at least one projection on an inside wall of the cavity, wherein the rotation of a second container with respect to the container to detachably couple the container and the second container stops upon a top face of the top portion of the second container reaching the at least one projection on an inside wall of the cavity of the container, wherein a cap of the second container includes an object, the object being a straw or a statuette, and the cavity of the bottom portion of the container includes an insertable region such that when the container and the second container are detachably coupled upon reaching the at least one projection, the straw or the statuette is received in the insertable region.

5. The container according to claim 3 or 4, wherein:

an outer part of the at least one spiral thread on the exterior face of the top portion of the second container has a wider diameter than the cap and contacts the at least one spiral thread of the cavity of the bottom portion of the container when the container and the second container are detachably coupled, and an inner part of the at least one spiral thread on the exterior face of the top portion of the second container includes a narrower diameter than the cap and does not contact the at least one spiral thread of the cavity of the bottom portion of the container when the container and the second container are detachably coupled, the inner part extending upwardly and forming a rim protruding outwardly from an exterior face of the top portion of the second container.

6. The container according to claim 5, wherein:

the at least one spiral thread of the top portion of the container, the at least one spiral thread of the top portion of the second container, and the at least one spiral thread of the bottom portion of the container each includes at least one gap that allows air or liquid to escape from the cavity or the main body of the container, and the at least one gap of the at least one spiral thread of the top portion of the second container is aligned with the at least one gap of the at least one spiral thread of the cavity of the bottom portion of the container when the container and the second container are detachably coupled.

7. The container according to claim 5, wherein the inner wall of the cavity has at least one rib protruding toward an inner space of the main body of the container.

8. The container according to claim 2, wherein:

the at least one spiral thread of the top portion of the container, the at least one spiral thread of the top portion of the second container, and the at least one spiral thread of the bottom portion of the container each includes at least one gap that allows air or liquid to escape from the cavity or the main body of the container, and the at least one gap of the at least one spiral thread of the top portion of the second container is aligned with the at least one gap of the at least one spiral thread of the cavity of the bottom portion of the container when the container and the second container are detachably coupled.

9. The container according to claim 2, wherein the top portion of the second container includes a cap having an object, the object being a straw or a statuette, and the cavity further includes an insertable region configured to receive the top portion of the second container when the container and the second container are detachably coupled.

10. The container according to claim 2, wherein:

an upper part of the inside wall of the cavity is tapered to provide various sized diameter widths, upon rotation of the second container with respect to the container to detachably couple the container and the second container, the rotation stops upon a top face of the top portion of the second container reaching the tapered upper part of the inside wall of the cavity, a cap of the second container includes an object, the object being a straw or a statuette, and the cavity of the bottom portion of the container includes an insertable region such that when the container and the second container are detachably coupled upon stopping rotation upon the top face of the top portion of the second container reaching the tapered upper part of the inside wall of the cavity, the straw or the statuette is received in the insertable region.

11. The container according to claim 2, wherein:

an upper part of the inside wall or a roof of the cavity is round, and upon rotation of the second container with respect to the container to detachably couple the container and the second container, the rotation stops upon a top face of the top portion of the second container reaching the round upper part of the inside wall or the roof of the cavity, a cap of the second container includes an object, the object being a straw or a statuette, and the cavity of the bottom portion of the container includes an insertable region such that when the container and the second container are detachably coupled upon stopping rotation upon the top face of the top portion of the second container reaching the round upper part of the inside wall or the roof of the cavity, the straw or the statuette is received in the insertable region.

12. The container according to claim 10, wherein:

the tapered upper part of the inside wall of the cavity has at least one groove or gap which allows air to escape through the groove or the gap from the cavity or the main body of the second container when the container and the second container are detachably coupled and the second container does not have a cap, and the groove or the gap includes a cavity, which is joined with each of at least one rib of the inner wall of the cavity of the bottom of the container.

13. The container according to claim 11, wherein:

the round upper part of the inside wall or the roof of the cavity has at least one groove or gap which allows air to escape through the groove or the gap from the cavity or the main body of the second container when the container and the second container are detachably coupled and the second container does not have a cap, and the groove or the gap includes a cavity, which is joined with each of at least one rib of the inner wall of the cavity of the bottom of the container.

14. The container according to claim 10, wherein:

an outer part of the at least one spiral thread on the exterior face of the top portion of the second container has a wider diameter than the cap and contacts the at least one spiral thread of the cavity of the bottom portion of the container when the container and the second container are detachably coupled, and an inner part of the at least one spiral thread on the exterior face of the top portion of the second container includes a narrower diameter than the cap and does not contact the at least one spiral thread of the cavity of the bottom portion of the container when the container and the second container are detachably coupled, the inner part extending upwardly and forming a rim protruding outwardly from the exterior face of the top portion of the second container.

15. The container according to claim 11, wherein:

an outer part of the at least one spiral thread on the exterior face of the top portion of the second container has a wider diameter than the cap and contacts the at least one spiral thread of the cavity of the bottom portion of the container when the container and the second container are detachably coupled, and an inner part of the at least one spiral thread on the exterior face of the top portion of the second container includes a narrower diameter than the cap and does not contact the at least one spiral thread of the cavity of the bottom portion of the container when the container and the second container are detachably coupled, the inner part extending upwardly and forming a rim protruding outwardly from the exterior face of the top portion of the second container.

16. The container according to claim 14, wherein:

the tapered upper part of the inside wall of the cavity has at least one groove or gap which allows air to escape through the groove or the gap from the cavity or the main body of the second container when the container and the second container are detachably coupled and the second container does not have a cap, and the groove or the gap includes a cavity, which is joined with each of at least one rib of the inner wall of the cavity of the bottom of the container.

17. The container according to claim 15, wherein:

the round upper part of the inside wall or the roof of the cavity has at least one groove or gap which allows air to escape through the groove or the gap from the cavity or the main body of the second container when the container and the second container are detachably coupled and the second container does not have a cap, and the groove or the gap includes a cavity, which is joined with each of at least one rib of the inner wall of the cavity of the bottom of the container.

18. The container according to claim 14, wherein the cavity further comprises an insertable region configured to receive the top portion of the second container.

19. The container according to claim 15, wherein the cavity further comprises an insertable region configured to receive the top portion of the second container.

20. The container according to claim 14, wherein:

the at least one spiral thread of the top portion of the container, the at least one spiral thread of the top portion of the second container, and the at least one spiral thread of the cavity of the bottom portion of the container each has at least one gap which can allow air or liquid to escape through the gap from the cavity or a main body of the container, and the at least one gap of the at least one spiral thread of the top portion of the second container is aligned with the at least one gap of the at least one spiral thread of the cavity of the bottom portion of the container when the container and the second are detachably coupled.

21. The container according to claim 15, wherein:

the at least one spiral thread of the top portion of the container, the at least one spiral thread of the top portion of the second container, and the at least one spiral thread of the cavity of the bottom portion of the container each has at least one gap which can allow air or liquid to escape through the gap from the cavity or a main body of the container, and the at least one gap of the at least one spiral thread of the top portion of the second container is aligned with the at least one gap of the at least one spiral thread of the cavity of the bottom portion of the container when the container and the second are detachably coupled.

22. The container according to claim 2, wherein:

an outer part of the at least one spiral thread on the exterior face of the top portion of the second container has a wider diameter than the cap and contacts the at least one spiral thread of the cavity of the bottom portion of the container when the container and the second container are detachably coupled, and an inner part of the at least one spiral thread on the exterior face of the top portion of the second container includes a narrower diameter than the cap and does not contact the at least one spiral thread of the cavity of the bottom portion of the container when the container and the second container are detachably coupled, the inner part extending upwardly and forming a rim protruding outwardly from an exterior face of the top portion of the second container.

23. The container according to claim 22, wherein:

the at least one spiral thread of the top portion of the container, the at least one spiral thread of the top portion of the second container, and the at least one spiral thread of the bottom portion of the container each includes at least one gap that allows air or liquid to escape from the cavity or the main body of the container, and the at least one gap of the at least one spiral thread of the top portion of the second container is aligned with the at least one gap of the at least one spiral thread of the cavity of the bottom portion of the container when the container and the second container are detachably coupled.

24. The container according to claim 22, wherein the inner wall of the cavity has at least one rib protruding toward an inner space of the main body of the container.

25. The container according to claim 22, further comprising:

a plurality of tapered projections on an inside wall of the cavity, wherein the rotation of a second container with respect to the container to detachably couple the container and the second container stops upon a top face of the top portion of the second container reaching at least one projection of the a plurality of tapered projections on an inside wall of the cavity of the container.

26. The container according to claim 2, further comprising:

a plurality of tapered projections on an inside wall of the cavity, wherein the rotation of a second container with respect to the container to detachably couple the container and the second container stops upon a top face of the top portion of the second container reaching at least one projection of the a plurality of tapered projections on an inside wall of the cavity of the container.

27. A container comprising:

a main body;

a top portion having an outside diameter smaller than the main body, at least one spiral thread around and protruding outwardly from an exterior face of the top portion, a lip edge of a mouth of the container, an aluminum lid closing the mouth of the container, and a neck below the lip edge of the mouth; and a bottom portion having an end face and a first cavity in a center of the end face, the first cavity having an opening into which a top portion of a second container can be inserted, and the bottom portion having at least one spiral thread extending inwardly from an inside wall of the first cavity, and the bottom portion, when aligned with at least one spiral thread on an exterior face of the top portion of the second container, receives the at least one spiral thread of the second container upon rotation of the second container with respect to the container to detachably couple the container and the second container, wherein the main body extends from the top portion to the bottom portion, the first cavity of bottom portion of the container includes an insertable region such that when the container and the second container are detachably coupled upon stopping the rotation, an object being a projection at the top portion of the second container is received in the insertable region, the inside wall of the first cavity or each of the at least one spiral thread of the top portion of the container, the at least one spiral thread of the top of the second container, and the at least one spiral thread of the bottom portion of the container includes at least one gap or groove that allows air or liquid to escape through the gap or the groove from the first cavity of the bottom portion of the container or the main body of the second container when the container and the second container are detachable coupled and the second container does not have a lid, and the gap or the groove includes a second cavity that joins the first cavity and is formed by at least one rib of the inner wall, the at least one rib of the inner wall extending the second cavity upwardly in the direction of the top portion of the container, and the at least one rib of the inner wall extending the second cavity radially outward beyond a radius of the mouth diameter.

28. The container according to claim 27, further comprising:

a plurality of tapered inside walls on an inside wall of the first cavity of the container, wherein the rotation of the second container, with respect to the container to detachably couple the container and the second container, stops upon a top face of the top portion of the second container reaching at least one tapered inside wall of the plurality of tapered inside walls of the first cavity of the container.

* * * * *